US008683772B2

(12) United States Patent
Friis

(10) Patent No.: US 8,683,772 B2
(45) Date of Patent: Apr. 1, 2014

(54) TRUSS MOUNTING BRACE

(75) Inventor: Niels Friis, Malling (DK)

(73) Assignee: Simpson Strong-Tie Company, Inc., Pleasontan, CA (US)

( * ) Notice: Subject to any disclaimer, the term of this patent is extended or adjusted under 35 U.S.C. 154(b) by 0 days.

(21) Appl. No.: 12/995,444

(22) PCT Filed: Jun. 2, 2009

(86) PCT No.: PCT/IB2009/006131
§ 371 (c)(1),
(2), (4) Date: Mar. 17, 2011

(87) PCT Pub. No.: WO2009/147533
PCT Pub. Date: Dec. 10, 2009

(65) Prior Publication Data

US 2011/0154770 A1 Jun. 30, 2011

(30) Foreign Application Priority Data

Jun. 2, 2008 (GB) ..... 0810022.4

(51) Int. Cl.
*E04C 3/02* (2006.01)

(52) U.S. Cl.
USPC ..... 52/691; 52/745.2

(58) Field of Classification Search
USPC ..... 52/655.1, 690, 696, 691, 745.2, 127.2
See application file for complete search history.

(56) References Cited

U.S. PATENT DOCUMENTS 651,139 A 6/1900 Gays
688,230 A 12/1901 Isrig et al.
1,106,845 A 8/1914 Ream
1,204,956 A 11/1916 Day
1,214,738 A 2/1917 Wolf
1,378,448 A 5/1921 Gilbert
1,458,498 A 6/1923 Piel (Continued)

FOREIGN PATENT DOCUMENTS

AU 0484192 A1 6/1974
CA 0502492 5/1954

(Continued)

OTHER PUBLICATIONS

"META/HETA/HHETA/HETAL/TSS Embedded Truss Anchors and Truss Seat Snap-In". Simpson Strong-Tie Wood Connectors Catalog, 1999, p. 108. Simpson Strong-Tie Company, Inc., U.S.A.

(Continued)

*Primary Examiner* — Jeanette E Chapman
*Assistant Examiner* — Daniel Kenny
(74) *Attorney, Agent, or Firm* — James R. Cypher; Charles R. Cypher

(57) ABSTRACT

A truss mounting brace (1) for use during installation of trusses (19, 21, 22). The truss mounting brace (1) may also be used as a permanent spacer between two trusses (19, 21, 22). The truss mounting brace (1) comprises a mounting section (4) arranged to be mounted on a truss (19, 21, 22), a gripping section (3) and an oblong body section (5) connecting the mounting section (4) and the gripping section (3). The gripping section (3) has a gripping mechanism (6) arranged to receive and to engage another element interlockingly. The present invention also relates to a method of installing two or more trusses, use of the truss mounting brace, and a method of manufacturing the truss mounting brace.

19 Claims, 7 Drawing Sheets

(56) References Cited

U.S. PATENT DOCUMENTS

| | | | | |
|---|---|---|---|---|
| 1,461,704 | A | 7/1923 | Bonsall | |
| 1,514,577 | A | 11/1924 | Burrell | |
| 1,523,970 | A | 1/1925 | Jakob | |
| 1,533,041 | A | 4/1925 | Slater | |
| 1,558,239 | A | 10/1925 | Costello | |
| 1,614,334 | A | 1/1927 | Wright | |
| 1,649,226 | A | 11/1927 | Gstalder | |
| 1,656,741 | A | 1/1928 | Lane | |
| 1,685,729 | A | 9/1928 | Stone | |
| 1,880,480 | A | 10/1932 | Ragsdale | |
| 2,037,736 | A | 4/1936 | Payne et al. | |
| 2,042,370 | A | 5/1936 | Walker | |
| 2,116,263 | A | 5/1938 | Harbaugh | |
| 2,302,101 | A | 11/1942 | Boydstun | |
| 2,338,435 | A | 1/1944 | Hoyt | |
| 2,567,586 | A | 9/1951 | Werder | |
| 2,619,887 | A | 12/1952 | Burrows | |
| 2,670,919 | A | 3/1954 | Esoldi | |
| 2,686,959 | A * | 8/1954 | Robinson | 33/613 |
| 2,806,495 | A | 9/1957 | Merkle et al. | |
| 2,856,646 | A | 10/1958 | Latimer et al. | |
| 2,947,119 | A | 8/1960 | Puckett, Jr. | |
| 2,963,127 | A | 12/1960 | Manville | |
| 2,964,807 | A | 12/1960 | Kennedy | |
| 3,000,145 | A | 9/1961 | Fine | |
| 3,010,162 | A | 11/1961 | Klein | |
| 3,011,229 | A | 12/1961 | Mutchnik | |
| 3,080,084 | A | 3/1963 | Appleton | |
| 3,102,306 | A | 9/1963 | Hutchinson | |
| 3,152,671 | A | 10/1964 | Mallory, Jr. | |
| 3,163,386 | A | 12/1964 | Collins | |
| 3,201,874 | A | 8/1965 | Christy | |
| 3,214,126 | A | 10/1965 | Roos | |
| 3,332,196 | A | 7/1967 | Tuttle | |
| 3,335,993 | A | 8/1967 | Tuttle | |
| 3,518,421 | A | 10/1967 | Cogdill | |
| 3,389,885 | A | 6/1968 | Friedman et al. | |
| 3,422,585 | A | 1/1969 | Dismukes | |
| 3,718,307 | A | 8/1969 | Albanese | |
| 3,467,418 | A | 9/1969 | Redditt | |
| 3,528,636 | A | 9/1970 | Schmit | |
| 3,591,997 | A | 7/1971 | Tennison, Jr. | |
| 3,604,176 | A | 9/1971 | Campbell | |
| 3,778,952 | A * | 12/1973 | Soucy | 52/667 |
| 3,875,719 | A | 4/1975 | Menge | |
| 3,959,945 | A | 6/1976 | Allen | |
| 3,988,872 | A | 11/1976 | Adamson et al. | |
| 4,016,698 | A | 4/1977 | Rogers | |
| 4,038,803 | A | 8/1977 | Schoeller | |
| 4,040,232 | A | 8/1977 | Snow et al. | |
| 4,062,512 | A | 12/1977 | Arnold | |
| 4,171,172 | A | 10/1979 | Johnston | |
| 4,234,174 | A | 11/1980 | Cardono | |
| 4,237,614 | A | 12/1980 | Williams | |
| 4,246,736 | A | 1/1981 | Kovar et al. | |
| 4,253,224 | A | 3/1981 | Hickman et al. | |
| 4,253,649 | A | 3/1981 | Hewson | |
| 4,322,064 | A | 3/1982 | Jarvis | |
| 4,339,903 | A | 7/1982 | Menge | |
| 4,342,177 | A | 8/1982 | Smith | |
| 4,350,279 | A | 9/1982 | Haley | |
| 4,361,999 | A | 12/1982 | Sidney | |
| 4,370,843 | A | 2/1983 | Menge | |
| 4,420,921 | A | 12/1983 | Hardin | |
| 4,422,792 | A | 12/1983 | Gilb | |
| 4,490,956 | A | 1/1985 | Palacio et al. | |
| 4,503,652 | A | 3/1985 | Turner | |
| 4,513,994 | A | 4/1985 | Dover et al. | |
| 4,524,554 | A | 6/1985 | Simpson | |
| 4,563,851 | A | 1/1986 | Long | |
| 4,570,407 | A | 2/1986 | Palacio et al. | |
| 4,604,845 | A | 8/1986 | Brinker | |
| 4,625,415 | A | 12/1986 | Diamontis | |
| 4,637,195 | A | 1/1987 | Davis | |
| 4,669,235 | A | 6/1987 | Reinen | |
| 4,704,829 | A | 11/1987 | Baumker, Jr. | |
| D293,416 | S * | 12/1987 | Krueger | D8/373 |
| 4,712,340 | A | 12/1987 | Sogge | |
| 4,717,101 | A | 1/1988 | Harrod | |
| 4,843,726 | A | 7/1989 | Ward | |
| 4,912,894 | A | 4/1990 | Platt | |
| 4,928,867 | A | 5/1990 | Jensen | |
| 4,958,814 | A | 9/1990 | Johnson | |
| 5,031,886 | A | 7/1991 | Sosebee | |
| D318,785 | S | 8/1991 | Dean | |
| 5,044,582 | A | 9/1991 | Walters | |
| 5,074,515 | A | 12/1991 | Norwood, Jr. | |
| 5,129,153 | A | 7/1992 | Burns, Sr. | |
| 5,161,345 | A | 11/1992 | Sobjack, Sr. | |
| 5,214,900 | A | 6/1993 | Folkerts | |
| 5,240,032 | A | 8/1993 | Mizioch | |
| 5,315,803 | A | 5/1994 | Turner | |
| 5,324,132 | A | 6/1994 | Hunter et al. | |
| 5,367,853 | A | 11/1994 | Bryan | |
| 5,388,378 | A | 2/1995 | Frye | |
| 5,407,182 | A | 4/1995 | Hartley | |
| 5,412,920 | A | 5/1995 | Hess | |
| 5,454,203 | A | 10/1995 | Turner | |
| 5,490,334 | A | 2/1996 | Payne | |
| 5,502,942 | A | 4/1996 | Gras et al. | |
| 5,524,854 | A | 6/1996 | McSwain et al. | |
| 5,555,694 | A | 9/1996 | Commins | |
| 5,580,036 | A | 12/1996 | Browning | |
| 5,606,837 | A | 3/1997 | Holizlander | |
| 5,628,119 | A | 5/1997 | Bingham et al. | |
| 5,638,655 | A | 6/1997 | Keck | |
| 5,678,799 | A | 10/1997 | Jorgensen et al. | |
| 5,699,639 | A | 12/1997 | Fernandez | |
| 5,870,874 | A | 2/1999 | Brothers | |
| 5,884,411 | A | 3/1999 | Raber | |
| 5,884,448 | A | 3/1999 | Pellock | |
| 5,899,042 | A | 5/1999 | Pellock | |
| 5,934,631 | A | 8/1999 | Becker | |
| 5,937,531 | A | 8/1999 | Menk et al. | |
| 5,937,608 | A | 8/1999 | Kucirka | |
| 5,938,157 | A | 8/1999 | Reiker | |
| 5,992,122 | A | 11/1999 | Rohrmoser et al. | |
| 6,070,336 | A | 6/2000 | Rodgers | |
| 6,105,331 | A * | 8/2000 | Rinklake et al. | 52/650.1 |
| 6,155,019 | A | 12/2000 | Ashton et al. | |
| 6,170,218 | B1 | 1/2001 | Shahnazarian | |
| 6,185,898 | B1 | 2/2001 | Pratt | |
| 6,230,466 | B1 | 5/2001 | Pryor | |
| 6,230,467 | B1 | 5/2001 | Leek | |
| 6,354,055 | B1 | 3/2002 | Shaw et al. | |
| 6,375,242 | B1 | 4/2002 | Zingerman | |
| 6,393,794 | B1 * | 5/2002 | Pellock | 52/696 |
| 6,463,711 | B1 | 10/2002 | Callies | |
| 6,523,321 | B1 | 2/2003 | Leek et al. | |
| 6,546,678 | B1 | 4/2003 | Pryor et al. | |
| 6,988,346 | B2 | 1/2006 | Shamroukh et al. | |
| 6,993,882 | B2 | 2/2006 | Crawford et al. | |
| 7,273,210 | B2 | 9/2007 | Thurston et al. | |
| 7,275,731 | B1 | 10/2007 | Shinault | |
| 7,377,048 | B2 | 5/2008 | Koetter | |
| 7,748,187 | B2 * | 7/2010 | Sensenig | 52/489.1 |
| 2003/0200719 | A1 | 10/2003 | Koski | |
| 2005/0098697 | A1 | 5/2005 | Collins | |
| 2005/0117999 | A1 | 6/2005 | Lillegard | |
| 2006/0196068 | A1 | 9/2006 | Thompson et al. | |
| 2007/0200039 | A1 | 8/2007 | Petak | |
| 2009/0151294 | A1 * | 6/2009 | Staley | 52/655.1 |
| 2012/0159896 | A1 * | 6/2012 | Lin | 52/848 |

FOREIGN PATENT DOCUMENTS

| | | |
|---|---|---|
| DE | 1941737 | 2/1971 |
| DE | 29819351 | 3/1999 |
| EP | 1213399 | 6/2002 |
| FR | 2734252 | 11/1996 |
| GB | 2029484 | 3/1980 |
| GB | 1566160 | 4/1980 |
| GB | 2039582 | 8/1980 |
| GB | 2103264 | 2/1983 |

(56) References Cited

FOREIGN PATENT DOCUMENTS

| | | | |
|---|---|---|---|
| GB | 2163788 | A | 3/1986 |
| GB | 2228955 | A | 9/1990 |
| GB | 2460642 | | 10/2010 |
| WO | WO9629180 | A1 | 9/1996 |
| WO | WO01/69000 | | 10/2001 |
| WO | WO01/88299 | | 11/2001 |
| WO | WO2005/111341 | | 11/2005 |
| WO | WO2008/034165 | | 3/2008 |
| WO | WO2009/147533 | A2 | 12/2009 |
| WO | WO2009/147533 | A3 | 12/2009 |

OTHER PUBLICATIONS

"Lochbänder," "Lochblechstreifen," "Spanngerät" and "Spanngerät Typ 60." BMF product brochure, 1990, pp. 5 and 8, BMF Baubeschläge GmbH & Co. KG., Denmark.

"BMF Vindafstivningsstem 25", product brochure, 2000, 2 pages, BMF Bygningsbeslag A/S. Odder, Denmark.

"BMF Vindafstivningssystem 40/60", product brochure, 2000, 2 pages, BMF Bygningsbeslag A/S. Odder, Denmark.

"BMF Vindafstivningssystem." BMF Vindafstivningssystem product catalog, 2000, BMF Bygningsbeslag A/S. Odder, Denmark.

"Hulband, vindtrækband, bandstrammer, bandsænder." BMF Handvaerkerkatalog, Section 4,1989, pp. 4.00.0-4.11.1, BMF Bygningsbeslag A/S. Odder, Denmark.

"The Stabilizer Truss Brace", brochure, publication date unknown, 2 pages, Mitek, Inc., U.S.A.

"Mitek Stabilizer, Report No. NER-561", Jul. 1, 2000, p. 1-3, National Evaluation Service, Inc., U.S.A.

"TS TST TUC Truss Products," Tee-Lok Wood Connectors,1995, p. 10, Tee-Lok Corporation, U.S.A.

"Truslock Spacing Tools" Advertisement in Journal of Light Construction, Sep. 1999, Builderburg Partners, Ltd., U.S.A.

"Don't Just Space It, Brace-It", brochure, publication date unknown, 2 pages, Truswal System, U.S.A.

Mike Guertin, "Adjustable Trusss Braces" Journal of Light Construction, Mar. 1999, p. 10, Builderburg Partners, Ltd., U.S.A.

Rick Arnold and Mike Guertin, "Installing Gable Roof Trusses," Journal of Light Construction, Dec. 1998, pp. 37-42, Builderburg Partners, Ltd., U.S.A.

"Space and Brace Trusses Simply by Folding Over," Truslock-Spacing Tools, date of publication unknown, p. 4, Trulock, USA.

"TSX Truss Spacer", publication date unknown, 2 pages, United Steel Products Company, U.S.A.

"Commentary and Recommendations for Handling and Installing Bracing, HIB-91", 1991, Truss Plate Institute, U.S.A.

"Encyclopedia of Trusses", publication date unknown, pp. 10-14, Alpine Engineered Products, U.S.A.

* cited by examiner

TRUSS MOUNTING BRACE

The present invention relates to a truss mounting brace and, in particular, to a truss mounting brace for use during the installation of trusses. The truss mounting brace of the present invention may also be used as a permanent spacer between two or more trusses.

BACKGROUND ART

During the construction of a building, the walls are typically built or installed first whereupon the roof trusses are installed on the top of the walls. These roof trusses support the actual roof, e.g. plates or tiles.

At present, workers typically space and hold the roof trusses during installation by temporarily nailing a batten, a piece of splitwood or similar across adjacent trusses. When the permanent lathing or sheathing is attached to the trusses the temporary batten/spacers need to be removed. Mounting and removing these temporary spacers is time-consuming and they are usually damaged in the process so that they cannot be reused. Furthermore, installing these temporary spacers is highly dangerous. At the time of the installation of the trusses no scaffold is present apart from low scaffolds along the front/facade, thus forcing the workers to climb the trusses to attach the spacers. A drop from such height will cause major injuries for a worker. During installation of the trusses they are held by a crane which obviously has sufficient strength but often the stability and accuracy is low due to weather and the height of the crane.

EP 1213399 discloses a truss spacer and brace. This brace ensures the correct distance between two trusses. Furthermore, this brace is adapted to support the roof during heavy loads e.g. snow. The brace is fastened to the trusses by nails, screws or similar by a worker climbing the trusses. Such mounting process is similar to the process of using a lath and equally dangerous.

DESCRIPTION OF THE INVENTION

The present invention addresses the disadvantages of the prior art mentioned above, and provides a brace that minimises the need for workers to climb the trusses during their installation.

This aspect and the advantages becoming evident from the description below are obtained by a truss mounting brace arranged with a gripping section that has a gripping mechanism arranged to receive or be received and engage interlockingly with another element.

When a truss is provided with the truss mounting brace it is arranged to receive another element, e.g. another truss, and the installation of trusses is made less dangerous. The gripping mechanism of the truss mounting brace enables that the truss to be installed is locked to the previously placed truss without the necessity to nail or screw a temporary rafter or similarly to hold the truss in an upright position. Therefore, workers handling the trusses are no longer forced to climb to the top of the truss in order to secure the truss to be installed.

Furthermore, the truss mounting brace facilitates that during installation the trusses are placed with a predetermined distance. The constructional drawings of a building, e.g. a family house, determine the specifications for the distance between the trusses. Naturally, in order to achieve a building according to the desired quality and design these specifications must be observed. However, no scaffold is commonly present near the tip of the trusses during installation. Therefore, a worker is forced to climb near the top of the truss to ensure the correct distance to the previous truss and thereafter he must fix the truss in question in the correct distance. It is highly dangerous for the workers to climb the trusses when they are not properly secured and therefore such climbing must be avoided. The truss mounting brace according to the present invention facilitates that the installation of the trusses is faster and thus cheaper. The cost reduction is especially achieved due to minimising the time spent during the process of ensuring the correct distance, and at this step in the installation process, in addition to the workers spending time, an expensive crane is holding the truss.

Therefore, it is important that the positioning and securing of the trusses are carried out quickly and without jeopardising the safety of the workers.

According to an embodiment of the invention the mounting section arranged opposite the gripping section may have projecting engagement means (section arranged to cooperate interlockingly with the gripping mechanism of another truss mounting brace). This way, it is achieved that it is a part of a truss mounting brace that goes into locking engagement with the gripping section of a second truss mounting brace. Therefore, it is possible for the gripping mechanism of the truss mounting brace to engage the engagement section in a manner that is specifically adapted to receive said gripping mechanism. Thus, by having such projection engagement means it is achieved that the exact properties, e.g. strength, play, etc., of the connection between the gripping section and the projecting engagement means are known.

According to another embodiment of the invention the gripping section may comprise a locking mechanism e.g. a gravity activated locking mechanism similar to e.g. a pawl, which is a simple and cheap construction. Alternatively, the locking mechanism may be spring loaded, biased and/or snap fit. Furthermore, the locking mechanism could easily be developed further if necessary to optimise the interlocking function.

In yet another embodiment of the invention the oblong body section may be adjustable along its longitudinal axis. The adjustment could be carried out e.g. by having a number of holes for receiving e.g. a bolt, a rivet or other fastener(s) or fastening means in the oblong body section and corresponding holes in either the mounting section or the gripping section. In an embodiment of the invention the oblong body section may be extended ends of the gripping section and the mounting section. When the oblong body section is adjustable along its longitudinal axis it is possible to adapt the truss mounting brace on site according to the present conditions. Typically, the constructional drawings of e.g. a house to be built specify the distances between the trusses. However, often it is necessary to make adjustments on site in order to overcome unforeseen changes in the structure and therefore it may be an advantage if it is possible to adjust the length of the truss mounting brace.

In an additional embodiment of the invention the width of the mounting section can be wider than the width of the gripping section. This way it is possible to achieve a play between the gripping section and the engagement section and thereby it is achieved that the gripping section of one truss mounting brace engages easily with the engagement section of another similar truss mounting brace. When the trusses are mounted on the building, a crane is typically lifting the trusses by a wire or similar. Therefore, the positioning of the truss could be affected, e.g. by wind, twisting of the wire, and a play between the gripping section and the engagement section will help during the positioning of the one truss relative to the other. Furthermore, the play is beneficial during the fastening of the truss mounting brace itself onto the truss, because it allows for the worker, e.g. a carpenter, to be less accurate during the fastening of the truss mounting brace. If desired, a fastener hole or holes may be provided in the respective mounting and gripping sections of the truss mounting brace, each arranged so as to substantially overly the other or others when truss mounting braces are interconnected. This enables any play between interconnected truss mounting braces to be taken up (if desired) following installation with the use of fasteners to tighten and clamp the interconnected truss mounting braces together.

According to another embodiment of the present invention the mounting section can comprise a flange arranged essentially perpendicular to the oblong body section. The flange ensures that it is possible to achieve a firm connection, e.g. by nails or screws, between the truss and the truss mounting brace. Furthermore, by providing the mounting section with a flange perpendicular to the oblong body it is achieved that the truss mounting brace is fastened on the truss in an easy manner for the worker while the truss is e.g. lying on its side. When the truss is lying on its side it is possible for the worker to hold the truss mounting brace with one hand and fasten it to the truss with the other. In an alternative embodiment, the flange may take an alternative form. Instead, an angle bracket having two legs may be provided, with a first leg lying on and being affixed to the oblong body, and a second upstanding leg arranged substantially perpendicularly to the first leg. This second upstanding leg serves to function in the same manner as the flange described above.

According to yet another embodiment of the present invention the oblong body section may have at least one rib extending along at least half of the length of the longitudinal axis of the truss mounting brace. The at least one rib provides additional support to the oblong body. Thus, the truss mounting brace is adapted to minimise deflection.

According to another embodiment of the present invention the gripping mechanism could have a tapered outline or outlines projecting essentially perpendicularly from the longitudinal axis of the oblong body. This is advantageous in order to achieve that the gripping mechanism is positioning itself correctly when connecting to another element.

According to yet another embodiment of the present invention the mounting section and the gripping section may be detachable from each other so as to provide a modular component system (or kit) for forming a truss mounting brace. In the rough environment on a construction site the truss mounting braces can be damaged. Therefore, it is beneficial to have the opportunity to replace a damaged section with a spare mounting section or spare gripping section.

In one embodiment of the present invention the oblong body section can comprise a number of apertures. The apertures will let wind pass easily through the truss mounting brace and therefore the risk of the truss mounting brace being caught in the wind is minimised. Since the truss mounting braces are often used at construction sites where no shield against the wind is present and especially considering that the trusses are typically the highest point on the building, it is important that the brace is as steady as possible during the installation process. Furthermore, the apertures minimise the amount of material used for the truss mounting brace.

Advantageously, another embodiment of the truss mounting brace could be manufactured from galvanised steel having a thickness of 1-4 mm preferably 1.25-3.5 mm even more preferred 1.5 mm-2.5 mm. According to an embodiment of the invention the overall length of the truss mounting brace may be 30 cm-200 cm, preferably 50 cm-170 cm, even more preferred 60 cm-140 cm. Of course, it will be readily appreciated that a modular component system (or kit) for forming a truss mounting brace will provide for different/selectable lengths of truss mounting brace and/or adjustable length truss mounting braces.

According to another embodiment of the invention the truss mounting brace may be manufactured from plastic or a composite material.

The safety of the workers handling trusses can preferably be addressed by using a truss mounting brace. Therefore, a truss mounting brace according to the present invention is preferably used for mounting trusses.

According to yet a further aspect of the invention the truss mounting brace is preferably used for locking two or more trusses to each other during installation of trusses and furthermore, so as to assure a predefined space between them. Using the truss mounting brace for installation and for achieving the right distance between the trusses the workers handling the installation of the trusses can stay on scaffolds or similar means instead of climbing the trusses during installation of these.

According to yet a further aspect of the invention there is provided a method of installing two or more trusses, characterised in that the method comprises the steps:

- affixing at least one truss mounting brace according to the present invention to two or more trusses,
- putting in position a truss of the two or more trusses with its at least one truss mounting brace affixed, and
- offering up and putting in position a further truss of the two or more trusses with its at least one truss mounting brace affixed such that the at least one truss mounting brace of the further truss engages with the truss mounting brace of another truss of the two or more roof trusses.

According to yet a further aspect of the invention the truss mounting brace can preferably be manufactured by a method comprising the steps:

- providing sheet metal,
- punching or cutting a sheet with the unfolded outline thereby defining a mounting section, a oblong body section, a gripping section and punching or cutting apertures,
- folding a part of at least the oblong body section so as to have at least one rib,
- forming a flange for fastening the truss mounting brace to a truss either by folding a portion of the sheet metal out of its plane or by attaching an element such as an angle bracket, and
- mounting a locking mechanism at the gripping section. This way the manufacturing of the truss mounting brace is carried out in a way that is accessible in most places around the world. Thereby, expensive costs for special manufacturing equipment can be avoided.

According to another method of manufacturing, the truss mounting brace may be manufactured using an injection moulding process.

BRIEF DESCRIPTION OF THE DRAWINGS

Preferred embodiments of the present invention will now be described by way of example only with reference to the accompanying drawings, in which.

The present invention is described below by way of example with the assumption that the truss mounting brace is used to join two or more trusses. However, within the scope of the invention the truss mounting brace can be used in other applications as well.

Figure 1:
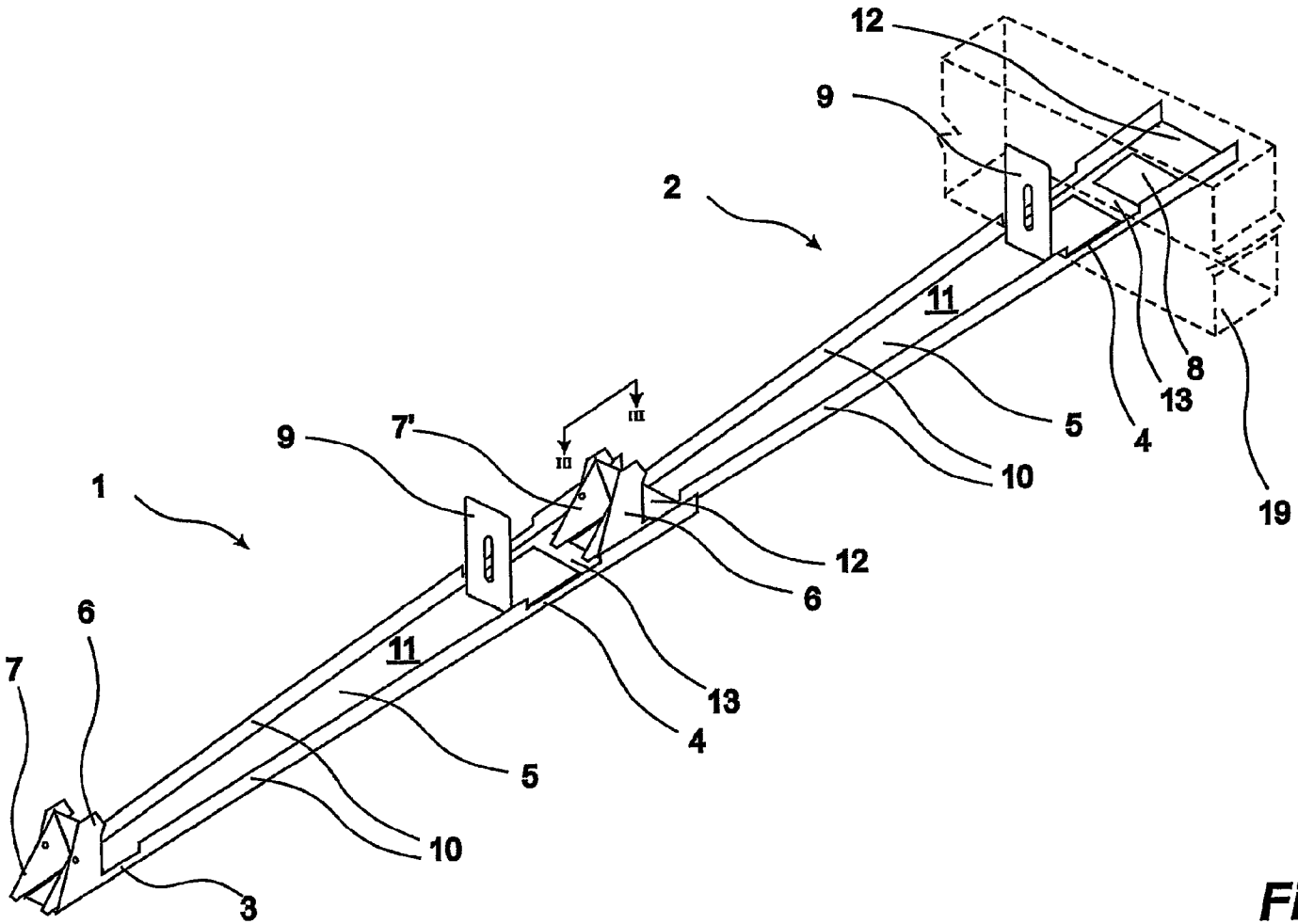
FIG. 1 shows a perspective view of a first embodiment of two engaged truss mounting braces according to the present invention.

In FIG. 1 a first truss mounting brace 1 and a second truss mounting brace 2 are shown. The truss mounting braces 1, 2 are identical and shown engaged with each other. The same parts on either truss mounting braces 1, 2 have identical reference numerals. Each truss mounting brace 1, 2 comprises a gripping section 3, a mounting section 4 and an oblong body section 5, the oblong body section 5 serving to connect the gripping section 3 and the mounting section 4. The gripping section 3 has a gripping mechanism 6 designed to help the gripping section 3 in being positioned correctly in relation to the element to which the gripping section 3 is intended to connect with. In the shown embodiment the gripping mechanism 6 is a tapered part of the material from which the truss mounting brace is manufactured, e.g. steel, having a thickness of 1.5 mm or 2 mm. However, the gripping mechanism 6 could have various shapes and could be a separate part mounted on or to the gripping section 3. At the gripping section 3 and in this embodiment a locking mechanism 7 is placed as an integrated part of the gripping mechanism 6. At the other end of the oblong body section 5, this being opposite the gripping section 3, the mounting section 4 is provided with an aperture 8 and a flange 9. The aperture 8 is adapted to receive the gripping mechanism 6 of another brace. Furthermore, the gripping section 3 and the aperture 8 are adapted to each other in such way that the locking mechanism 7 is activated when the gripping mechanism 6 is inserted in the aperture 8 of another brace, which will be explained in further detail below. It is seen that the truss mounting braces 1, 2 have two ribs 10 extending from a central part 11 of the oblong body section 5. These ribs 10 support the truss mounting brace 1, 2 so as to achieve a rigid brace easily controllable during the coupling of a truss mounting brace to another element. The ribs 10 are shown extending along the full length of the truss mounting brace 1, 2 although the height of the ribs 10 is varying. The ribs 10 are lower in the area between the flange 9 and the aperture 8 of the mounting section 4. This lower section of the ribs 10 is made for easily positioning of the truss mounting brace 1, 2 on a truss (not shown). Likewise, the ribs 10 are lower next to the gripping mechanism 6 in order to achieve that an end part 12 of the mounting section 4 of the truss mounting brace 1 is positioned securely and closer to the central part 11 of another truss mounting brace 2 when engaged with it in use.

However, depending on the specific use of the truss mounting brace 1, 2 the ribs 10 could be of equal height along their full length, or of varying height, length or any other suitable form. The flange 9 is bent from the central area 11 of the oblong body section 5 and is extending essentially perpendicular from the central area 11. Use of an angle bracket may be employed instead of, or as an adjunct to, the flange to perform the function of the flange.

The locking mechanism 7 illustrated is a gravity activated pawl connected to the gripping mechanism 6. It is seen that the locking mechanism 7' of the second truss mounting brace 2 is engaged lockingly with a locking section 13 of the first truss mounting brace 1. Furthermore, it is shown that the mounting section 4 is wider than the gripping section 3. In particular the aperture 8 is wider than the gripping mechanism 6 whereby positioning the gripping mechanism 6 and engaging the locking mechanism 7 in the aperture 8 is carried out more easily. Alternative locking mechanisms may be employed, e.g. spring loaded, biased and/or snap fit.

Shown with dashed lines, a see through part of a truss 19 is placed at the mounting section 4 of the second truss mounting brace 2. It is seen that the flange 9 is used for connecting the truss mounting brace 2 to the side 18 of the truss 19. According to this embodiment of the truss mounting brace 1, 2 it is mounted under the truss 19 in relation to the final position of the truss 19. Typically, component parts making up the trusses will be slanted in their installed position and therefore, the truss mounting brace 1, 2 may be tilted perpendicular to the longitudinal axis of the truss mounting brace.

Figure 2:
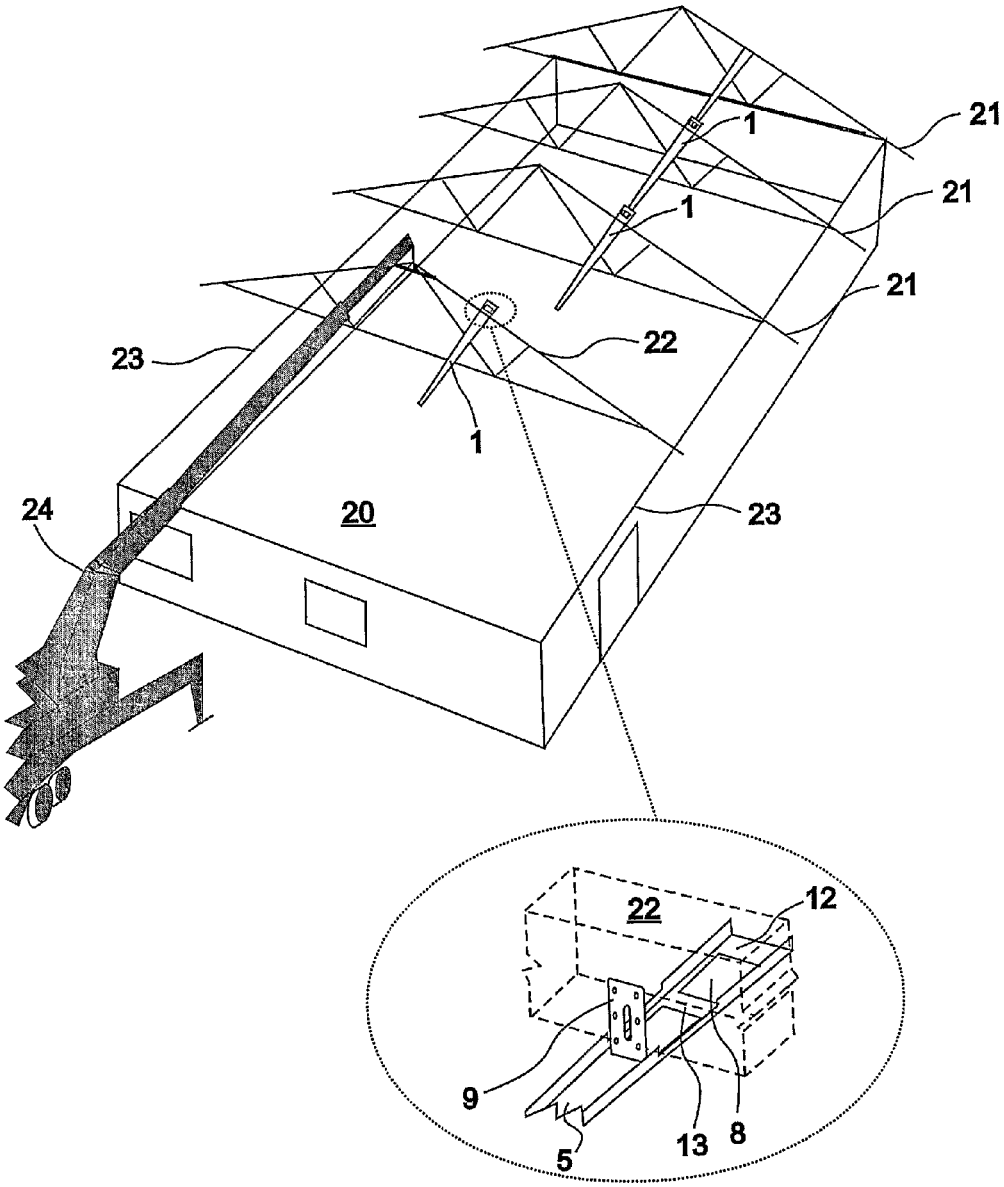
FIG. 2 shows a perspective view of a structure to which trusses are being mounted using a crane, said trusses coupled by a truss mounting brace according to the present invention.

FIG. 2 shows a schematic view of a house 20 where trusses 21, 22 are being installed. The trusses 21, 22 are also shown schematically as single lines. The trusses 21 and 22 are similar only differing by the fact that truss 22 is in the process of being installed. However, an enlarged sectional view indicated with dotted lines is showing that the flange 9 of that the truss mounting brace 1 (only partly shown) is fastened to a side of the truss 22 (only a part of the truss 22 is indicated by dashed line). Thus, the mounting section 4 of the truss mounting brace is positioned under the truss 22 and the engaging means (the aperture 8, the end part 12 and the locking section 13) is projecting on the opposite side of the truss 22 in relation to the oblong body section 5.

It is seen that three trusses 21 have been placed on the top rim 23 of the walls of the house 20. It is shown how the truss mounting brace 1 mounted on each truss 21 engages with a truss mounting brace 1 fastened to a previous installed truss. One truss 22 equal to the other trusses 21 is in the process of being installed by the crane 24 (only partly shown) which is lifting the truss 22 into its installed position parallel to the trusses 21. During the installation of the trusses 21, 22 the crane 24 only need to lift the truss from the ground or a truck into its approximate position and to lower the truss in order to achieve that the truss mounting brace 1 fastened on the e.g. the truss 22 engages another truss mounting brace 1 mounted on a previous truss e.g. truss 21. As mentioned previously, it is at this stage in the installation process particularly useful that the aperture 8 is wider than the width of the gripping mechanism 6 (not shown). Thus, the controller of the crane 24 has a certain play in order to position the truss and still lockingly engage the truss with the previous installed truss via the truss mounting braces 1.

It is seen that in some situations the truss installed at an end of a building beneficially has an embodiment of the truss mounting brace 1 adapted for this purpose. For example, it is not necessary for the first truss to have projecting engagement means for engaging with the gripping section of another truss mounting brace due to the simple fact that no truss will be mounted on that side. Likewise, when installing the last truss in a row of trusses the last truss will not need the oblong body section and the gripping section and is therefore simply a mounting section with projecting engagement means.

Furthermore, when e.g. the roof is a hip roof the truss mounting braces will be adapted to this purpose by e.g.

changing the angle between the flange and the oblong body section or similar (this embodiment is not shown) in order to comply with the specific needs.

The details of the actual engaging of the two truss mounting braces 1 are explained in further details in the following description.

Figure 3:
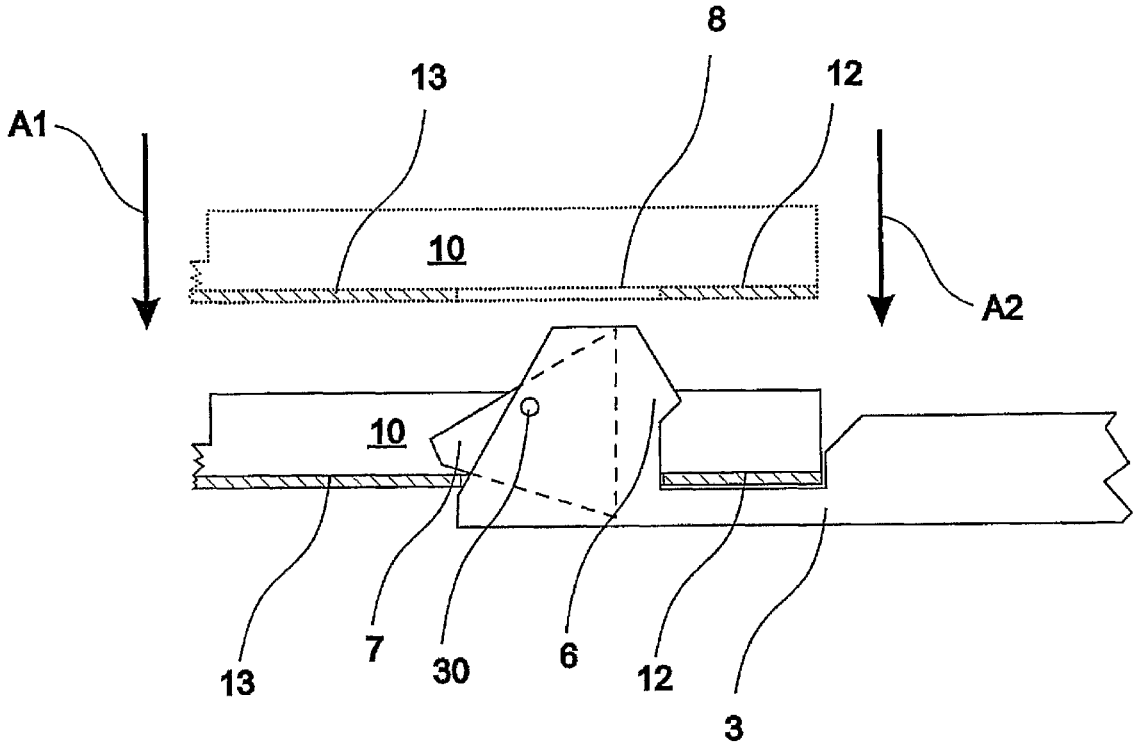
FIG. 3 shows a sectional view along the line III-III in FIG. 1 showing a gripping section of a truss mounting brace engaged lockingly in a receiving section of a second truss mounting brace.

FIG. 3 shows in a detailed view the engagement of a first truss mounting brace 1 (only a part of the mounting section 4 is shown) and a second truss mounting brace 2 (only the gripping section 3 is shown). Shown with a dotted outline the aperture 8 of the mounting section 4 of the first truss mounting brace 1 is positioned above the gripping mechanism 6. When lowering said mounting section 4 in the direction of the two arrows A1 and A2 the locking mechanism 7 will tip counter clockwise around an axis 30 in order to let the locking section 13 pass downwards. Due to the weight distribution of the locking mechanism 7 it will tip into its initial position when the locking section 13 (and thus the truss mounting brace 1) is lowered completely. As a result, the locking section 13 and thus the first truss mounting brace 1 will be engaged lockingly with the gripping section of the second truss mounting brace 2.

Figure 4:
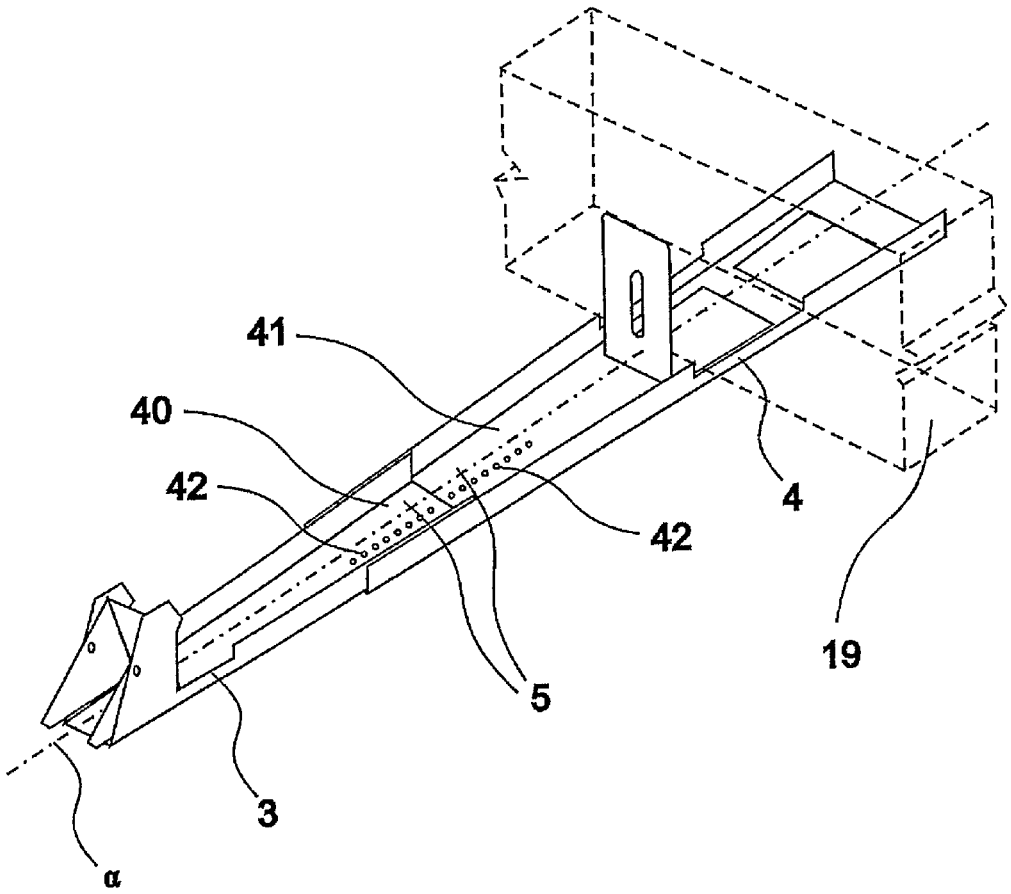
FIG. 4 shows a second embodiment of a truss mounting brace according to the present invention.

In FIG. 4 another embodiment of the truss mounting brace 1 is shown. The gripping section 3 and the mounting section 4 is connected by an oblong body section 5 that is adjustable in its length along the longitudinal axis a of the truss mounting brace 1. The oblong body section 5 is partly formed by an end section 40 of the gripping section 3 and partly by an end section 41 of the mounting section 4. A number of apertures/holes 42 facilitates that the two end sections 40, 41 can be connected, e.g. by a bolt, a rivet and/or other fasteners or fastening means. In this simple manner it is possible to adjust the truss mounting brace 1 to a desired length according to the present needs.

Figure 5:
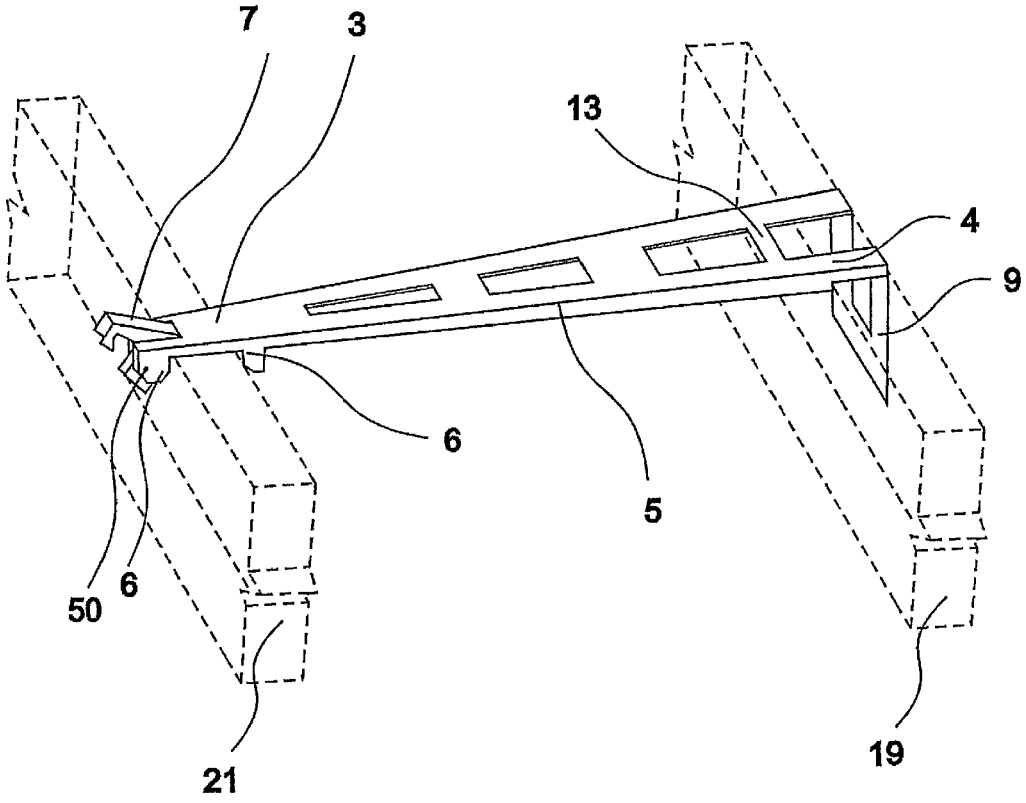
FIG. 5 shows a third embodiment of a truss mounting brace according to the present invention.

FIG. 5 shows an embodiment of the truss mounting brace 1 that is adapted to be mounted on top of a truss 19. In this embodiment the locking mechanism 7 is arranged so as to be activated when a truss is positioned in the gripping mechanism 6. The truss 21 positioned in the gripping mechanism 6 will push the locking mechanism 7 and the locking mechanism 7 will pivot around the axis 50 and thereby engage a similar truss mounting brace (not shown) by locking onto the locking section 13 of said similar truss mounting brace.

Figure 6A:
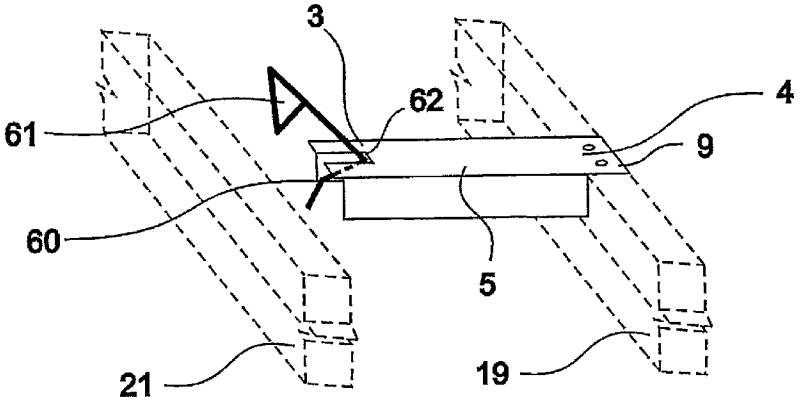
FIGS. 6A and 6B show a fourth embodiment of a truss mounting brace according to the present invention.
Figure 6B:
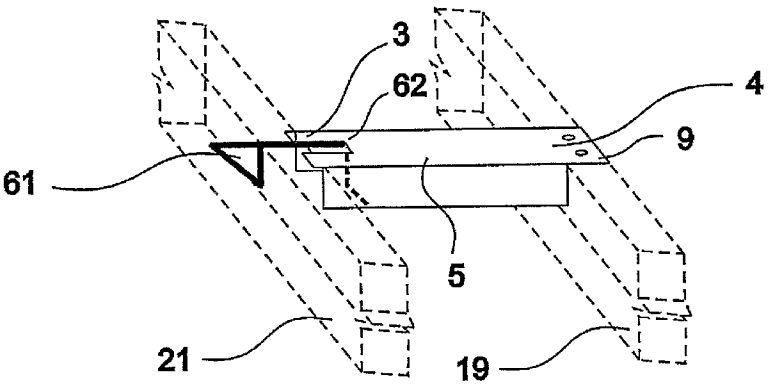

FIGS. 6A and 6B show yet another embodiment in which the gripping section 6 of the truss mounting brace 1 is adapted directly to engage lockingly with a truss 19. FIG. 6A shows the two truss 19 and 21 before they are connected and FIG. 6B shows the same two truss when connected via the truss mounting brace. The mounting section 4 has a flange 9 to fasten the truss mounting brace 1 onto a truss 19. When the truss 21 gets in contact with an arm 60 of the locking mechanism 7, a locking hook 61 will turn around an axis 62 and the locking hook 61 thereby prevents the truss 19 from moving sideways. Thus, the truss 19 is engaged lockingly with the previous installed truss 21 without the risk of jeopardising the safety of workers installing it.

Figure 7:
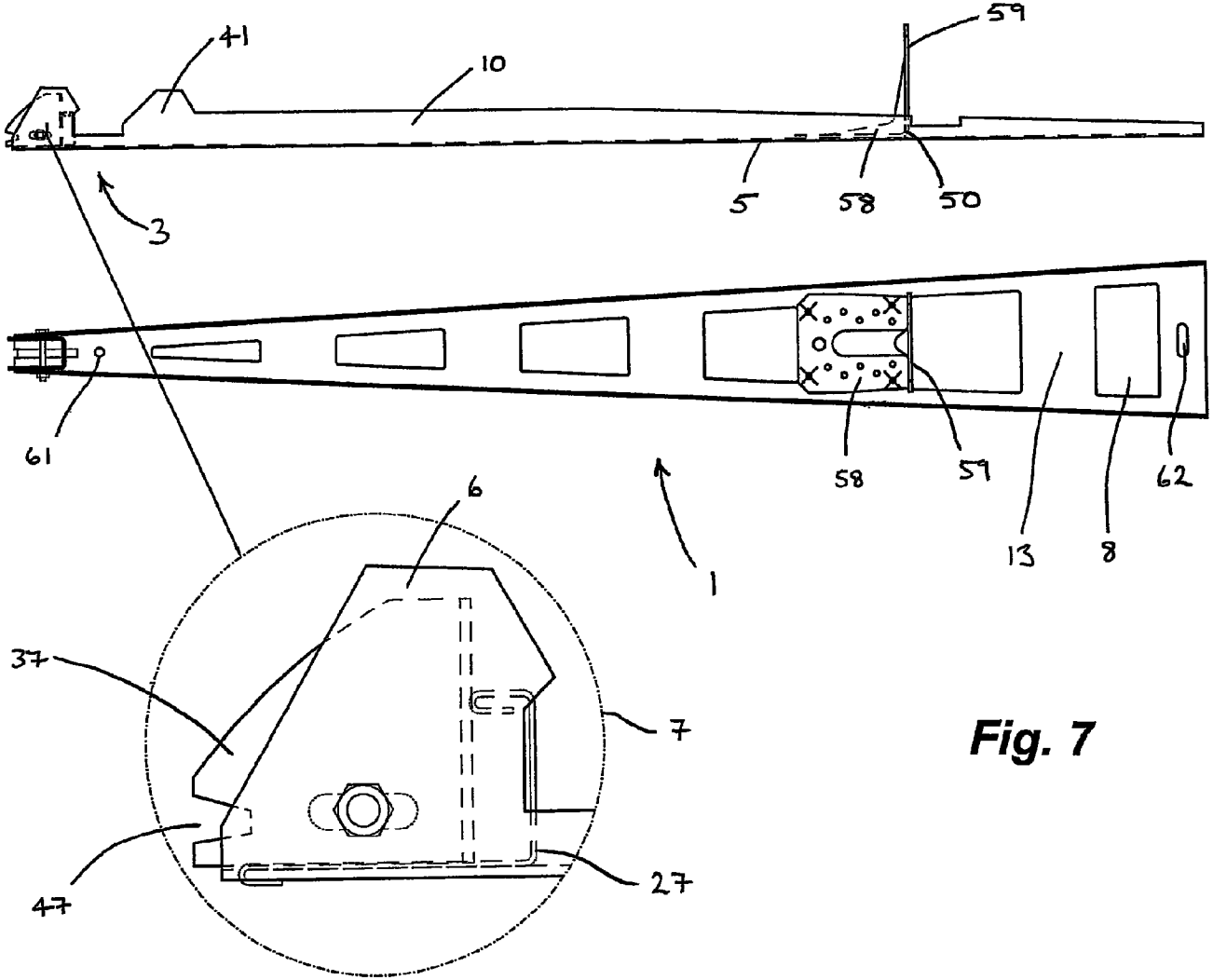
FIG. 7 shows a fifth embodiment of a truss mounting brace according to the present invention.

FIG. 7 shows a yet further embodiment of truss mounting brace 10 according to the present invention. In this embodiment, the locking mechanism 7 illustrated is a spring activated 27 longitudinal slider element 37 connected to the gripping mechanism 6. It will be understood that the locking mechanism 7, and in particular the recess 47 of the longitudinal slider element 37, engages lockingly with a locking section 13 of another truss mounting brace. Furthermore, it is shown that the ribs 10 are provided with upstanding ramp features 41 adjacent the gripping section 3. These ramp features 41 further assist in positioning the gripping mechanism 6 and engaging the locking mechanism 7 in the aperture 8 of another truss mounting brace. In this embodiment, flange 9 is dispensed with and replaced by an angle bracket 50 having two legs 58, 59. The first leg 58 lies on and is affixed to the oblong body 5, and the second upstanding leg 59 arranged substantially perpendicularly to the first leg 58. This second upstanding leg 59 serves to function in the same manner as the flange 9 described in alternative embodiments above. Finally, fastener holes 62, 61 are provided in the respective mounting 4 and gripping 3 sections of the truss mounting brace 10, each arranged so as to substantially overly the other when truss mounting braces are interconnected. This enables any play between interconnected truss mounting braces to be taken up (if desired) following installation, with the use of fasteners to tighten and clamp the interconnected truss mounting braces together.

Throughout the specification reference is made to the oblong body section 5 which serves to connect the gripping section 3 and the mounting section 4. Use of the term oblong herein simply means elongated in one dimension and confers no limitation as to shape or configuration.

Whilst preferred embodiments of the present invention have been described above and illustrated in the drawings, these are by way of example only and non-limiting. It will be appreciated by those skilled in the art that many alternatives are possible within the ambit of the invention. For example, any one or more or all of the features described, illustrated and/or claimed in the appended claims may be used in isolation or in various combinations in any embodiment. As such, any one or more features may be removed, substituted and/or added to any of the feature combinations described, illustrated and/or claimed. For the avoidance of doubt, any one or more of the features of any embodiment may be combined and/or used separately in a different embodiment with any other feature or features from any of the embodiments. As such, the true scope of the invention is that as set out in the appended claims.

The invention claimed is:

1. A connection between a first truss, a second truss, a first truss mounting brace, and a second truss mounting brace, the connection comprising:

a. said first truss having a front side and an opposite side disposed laterally therefrom on the opposed side of the first truss;

b. said second truss having a front side and an opposite side disposed laterally therefrom on the opposed side of the second truss, said second truss being disposed substantially parallel to and spaced a selected distance away from said first truss, said opposite side of said second truss facing and being disposed parallel to said front side of said first truss;

c. said first truss mounting brace attached to the first truss, the first truss mounting brace having a mounting section and an opposed gripping section with a body section connecting the opposed gripping section to the mounting section, said mounting section of said first truss mounting brace being attached to the first truss, said mounting section also projecting substantially away from said opposite side of said first truss and also from said opposite side of said second truss; and where said gripping section of said first truss mounting brace projects away from said front side of said first truss and extends towards said opposite side of said second truss, but said gripping section and said first truss mounting brace does not reach said opposite side of said second truss, such that said first truss mounting brace does not make any contact with said second truss;

d. said second truss mounting brace being attached to the second truss, the second truss mounting brace having a mounting section and an opposed gripping section with a body section connecting the opposed gripping section to the mounting section, said mounting section of said second truss mounting brace being attached to the second truss, said mounting section also projecting substantially away from said opposite side of said second truss and extending toward said front side of said first truss, but said mounting section and said second truss mounting brace does not reach said front side of said first truss, such that said second truss mounting brace does not make any contact with said first truss, said mounting section of said second truss mounting brace engaging said gripping section of said first truss mounting brace such that the second truss is braced by the first truss, and said gripping section of said second truss mounting brace projecting away from said front side of said second truss and projecting away from said front side of said first truss.

2. The connection of claim 1, further comprising:

a. a fastener; wherein, b. the gripping section of the first truss mounting brace is formed with an aperture that receives said fastener;

c. the mounting section of the second truss mounting brace is formed with an aperture that receives said fastener and is aligned with said aperture in said gripping section of said first truss mounting brace.

3. The connection of claim 1, wherein:

the body sections and the mounting sections of the first and second truss mounting brace are substantially elongated planar members.

4. The connection of claim 1, wherein:

the first and second truss mounting braces are formed from sheet metal.

5. The connection of claim 1, wherein:

the first and second truss mounting braces are formed by an injection molding process.

6. The connection of claim 1, wherein:

the body sections of the first and second truss mounting braces are elongated.

7. The connection of claim 6, wherein:

the body sections of the first and second truss mounting braces are formed with ribs that extend along at least half of the length of the selected distance between the first and second trusses.

8. The connection of claim 1, wherein:

a. said first and second truss mounting braces each has a longitudinal axis that is substantially aligned with the longitudinal axis of the other truss mounting brace;

b. said mounting section of said first truss mounting brace comprises a projecting member with an aperture therein, said aperture being bordered along the longitudinal axis of the first truss mounting brace by an end section disposed farther away from said first truss opposite side than said aperture and a locking section disposed closer to said first truss opposite side than said aperture;

c. said gripping section of said first truss mounting brace comprises a gripping mechanism;

d. and said mounting section of said second truss mounting brace comprises a projecting member with an aperture therein, said aperture being bordered along the longitudinal axis of the second truss mounting brace by an end section disposed farther away from said second truss opposite side than said aperture and a locking section disposed closer to said second truss opposite side than said aperture, said aperture of said mounting section of said second truss mounting brace receiving said gripping mechanism of said gripping section of said first truss mounting brace.

9. The connection of claim 8, wherein:

said gripping mechanism of said gripping section of said first truss mounting brace has a recess where said gripping mechanism can engage said end section of said mounting section of said second truss mounting brace.

10. The connection of claim 8, wherein:

the apertures in said mounting sections of said first and second truss mounting braces are wider than said gripping mechanism of said gripping section of said first truss mounting brace.

11. The connection of claim 8, wherein:

the mounting sections of the first and second truss mounting braces are formed with upstanding flanges disposed at an angle to the longitudinal axes of the first and second truss mounting braces, said upstanding flanges being formed to engage one of the front or opposite sides of one of the first or second trusses.

12. The connection of claim 8, wherein:

the first and second truss mounting braces are adjustable along the longitudinal axes of the first and second truss mounting braces.

13. The connection of claim 8, wherein:

the body sections of the first and second truss mounting braces are formed with enlarged apertures for allowing wind to pass through the body sections of the first and second truss mounting braces.

14. The connection of claim 8, wherein:

said gripping mechanism of said gripping section of said first truss mounting brace has a tapered projecting outline.

15. The connection of claim 14, wherein:

said gripping mechanism of said gripping section of said first truss mounting brace is disposed substantially perpendicular to said longitudinal axis of said first truss mounting brace.

16. The connection of claim 8, wherein:

said gripping mechanism of said gripping section of said first truss mounting brace has a moveable locking mechanism that engages said locking section of said mounting section of said second truss mounting brace.

17. The connection of claim 16, wherein:

said locking mechanism of gripping mechanism of said gripping section of said first truss mounting brace is gravity activated.

18. The connection of claim 16, wherein:

said locking mechanism of gripping mechanism of said gripping section of said first truss mounting brace is spring activated.

19. The connection of claim 16, wherein:

said locking mechanism of gripping mechanism of said gripping section of said first truss mounting brace is a spring activated longitudinal slide element.

* * * * *